US009556885B2

(12) United States Patent
Beers et al.

(10) Patent No.: US 9,556,885 B2
(45) Date of Patent: Jan. 31, 2017

(54) INLET SHROUD ASSEMBLY

(75) Inventors: Craig M. Beers, Wethersfield, CT (US); Darryl A. Colson, West Suffield, CT (US); Victoria S. Richardson, Hartford, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1128 days.

(21) Appl. No.: 13/592,830

(22) Filed: Aug. 23, 2012

(65) Prior Publication Data

US 2014/0056718 A1 Feb. 27, 2014

(51) Int. Cl.

| | |
|---|---|
| ***F04D 29/58*** | (2006.01) |
| ***F04D 25/06*** | (2006.01) |
| ***F04D 29/32*** | (2006.01) |
| ***F04D 19/00*** | (2006.01) |

(52) U.S. Cl.

CPC ..... *F04D 29/584* (2013.01); *F04D 19/00* (2013.01); *F04D 25/06* (2013.01); *F04D 29/329* (2013.01); *F04D 29/5806* (2013.01)

(58) Field of Classification Search

CPC ..... F04D 25/082; F04D 29/584

See application file for complete search history.

(56) References Cited

U.S. PATENT DOCUMENTS

| | | | |
|---|---|---|---|
| 1,940,466 | A | 12/1933 | Sneed |
| 2,527,229 | A | 10/1950 | Roubal |
| 2,752,515 | A | 6/1956 | Baudry et al. |
| 3,410,029 | A | 11/1968 | Savage |
| 3,433,020 | A | 3/1969 | Earle, Jr. et al. |
| 3,588,044 | A | 6/1971 | Reichrath et al. |
| 3,763,835 | A | 10/1973 | Miller et al. |
| 3,915,024 | A | 10/1975 | Mort |
| 3,949,550 | A | 4/1976 | Albrecht et al. |
| 3,999,872 | A | 12/1976 | Allison |
| 4,012,154 | A | 3/1977 | Durwin et al. |
| 4,439,106 | A | 3/1984 | Ferris et al. |
| 4,511,193 | A | 4/1985 | Geczy |
| 4,543,785 | A | 10/1985 | Patrick |
| 4,979,872 | A | 12/1990 | Myers et al. |
| 5,239,815 | A | 8/1993 | Barcza |

(Continued)

FOREIGN PATENT DOCUMENTS

| | | |
|---|---|---|
| CN | 201100246 | 8/2008 |
| CN | 101699075 | 4/2010 |
| EP | 2000675 A2 | 12/2008 |

OTHER PUBLICATIONS

Colson et al., U.S. Appl. No. 13/279,588, filed Oct. 24, 2011.

(Continued)

*Primary Examiner* — Christopher Verdier
*Assistant Examiner* — Brian O Peters
(74) *Attorney, Agent, or Firm* — Kinney & Lange, P.A.

(57) ABSTRACT

An inlet shroud assembly includes a hub and a shroud for a ram air fan. The hub includes a center bore, a first frustoconical section, a plurality of slotted cooling holes located on the first frustoconical section, a second frustoconical section, a plurality of circular cooling holes located on the second frustoconical section, a rim, a central cavity, and an annular cavity. The shroud includes a central disk with a center bore, a circular flange located on a radially outer edge of the central disk, and an outer disk with a web portion and a tip portion, the tip portion having a curved lip.

19 Claims, 8 Drawing Sheets

(56) References Cited

U.S. PATENT DOCUMENTS

| | | | | |
|---|---|---|---|---|
| 5,350,281 | A * | 9/1994 | Hagshenas | H02K 9/06 415/144 |
| 5,505,587 | A | 4/1996 | Ghetzler | |
| 5,529,316 | A | 6/1996 | Mattila | |
| 5,683,184 | A | 11/1997 | Striedacher et al. | |
| 6,299,077 | B1 | 10/2001 | Harmon et al. | |
| 6,380,647 | B2 | 4/2002 | Hayashi et al. | |
| 6,698,933 | B2 | 3/2004 | Lau | |
| 6,926,490 | B2 | 8/2005 | McAuliffe et al. | |
| 6,928,963 | B2 | 8/2005 | Karanik | |
| 6,966,174 | B2 | 11/2005 | Paul | |
| 7,165,939 | B2 | 1/2007 | Chen et al. | |
| 7,342,332 | B2 | 3/2008 | McAuliffe et al. | |
| 7,394,175 | B2 | 7/2008 | McAuliffe et al. | |
| 7,397,145 | B2 | 7/2008 | Struve et al. | |
| 7,757,502 | B2 | 7/2010 | Merritt et al. | |
| 7,952,241 | B2 | 5/2011 | Kato et al. | |
| 8,459,966 | B2 * | 6/2013 | Hipsky et al. | 417/369 |
| 2002/0171218 | A1 | 11/2002 | Bell | |
| 2006/0061221 | A1 | 3/2006 | McAuliffe et al. | |
| 2010/0055383 | A1 | 3/2010 | Schalla et al. | |
| 2012/0014784 | A1 | 1/2012 | Hipsky et al. | |
| 2013/0101436 | A1 * | 4/2013 | Colson et al. | 416/97 R |

OTHER PUBLICATIONS

Colson et al., U.S. Appl. No. 13/279,529, filed Oct. 24, 2011.
Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/279,497, filed Oct. 24, 2011.
Binek et al., U.S. Appl. No. 13/279,508, filed Oct. 24, 2011.
Chrabascz et al., U.S. Appl. No. 13/279,523, filed Oct. 24, 2011.
Chrabascz et al., U.S. Appl. No. 13/279,534, filed Oct. 24, 2011.
Office Action from Chinese Application Serial No. 201310371404.7, Dated Sep. 2, 2016, 6 pages.

* cited by examiner

INLET SHROUD ASSEMBLY

BACKGROUND

The present invention relates to an environmental control system. In particular, the invention relates to a ram air fan assembly for an environmental control system for an aircraft.

An environmental control system ("ECS") aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before being delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components designed to improve the operational efficiency of the ram air fan or to reduce its weight.

SUMMARY

According to the present invention, an inlet shroud assembly includes a hub and a shroud for a ram air fan. The hub includes a central hub with a center bore, a first frustoconical section radially outward and axially forward of the central hub, a plurality of slotted cooling holes on the first frustoconical section, a second frustoconical section radially outward and axially forward of the first frustoconical section, a plurality of circular cooling holes on the second frustoconical section, a rim radially outward and axially forward of the second frustoconical section, a central cavity axially forward of the central hub, and an annular cavity radially outward and axially forward of the central hub. The shroud includes a central disk with a center bore, a circular flange located on a radially outer edge of the central disk, and an outer disk. The outer disk includes a web portion extending radially outward and axially rearward of the central disk and a tip portion extending radially outward of the first section with a curved lip extending axially forward towards the central disk.

DETAILED DESCRIPTION

Figure 1:
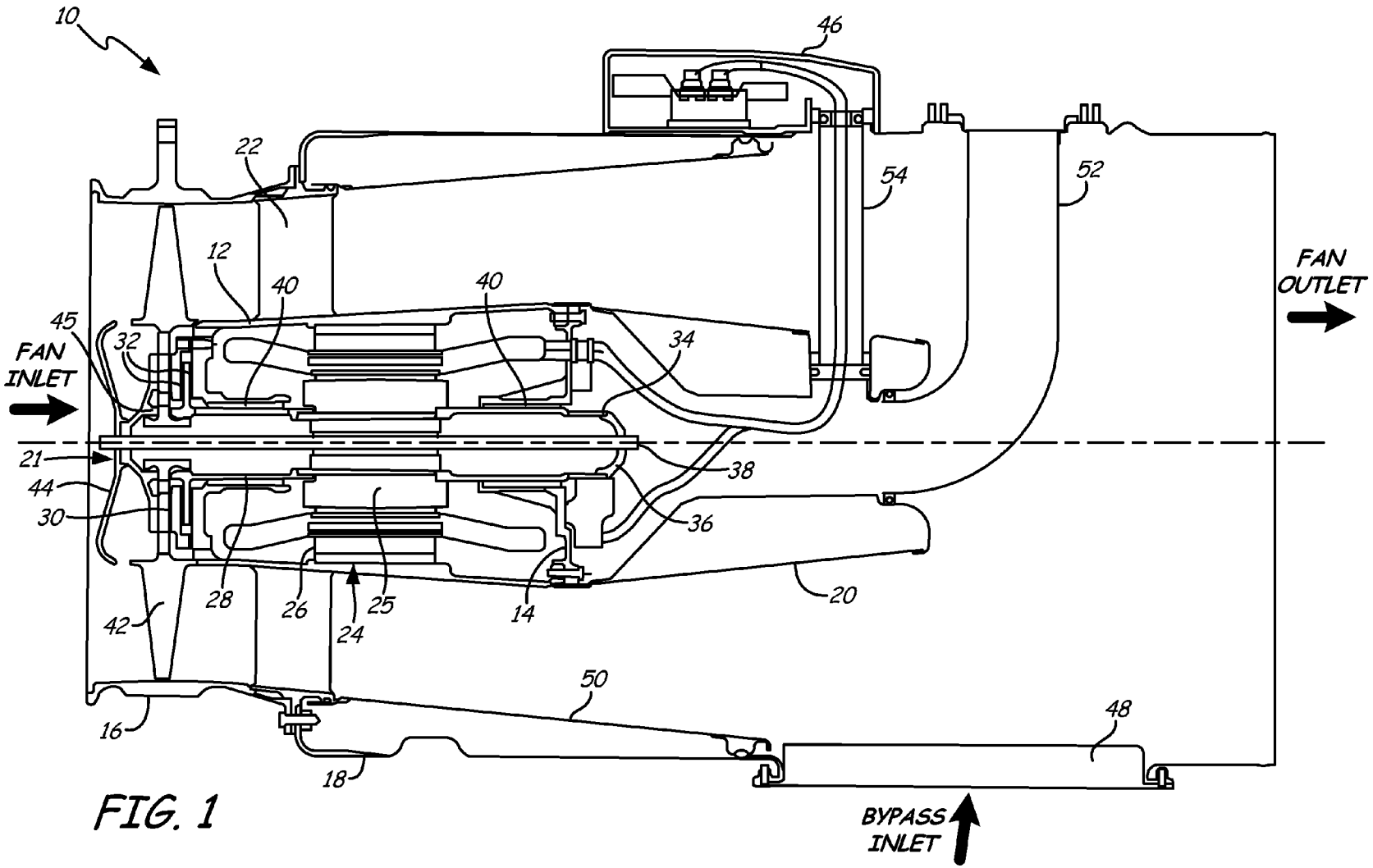
FIG. 1 is a cross-sectional view of a ram air fan assembly.

FIG. 1 illustrates ram fan air assembly 10 incorporating the present invention. Ram air fan assembly 10 includes fan housing 12, bearing housing 14, inlet housing 16, outer housing 18, and inner housing 20. Fan housing 12 includes fan struts 22, motor 24 (including motor rotor 25 and motor stator 26), thrust shaft 28, thrust plate 30, and thrust bearings 32. Bearing housing 14 includes journal bearing shaft 34 and shaft cap 36. Fan housing 12 and bearing housing 14 together include tie rod 38 and journal bearings 40. Inlet housing 16 contains fan rotor 42, shroud 44, and hub 45, in addition to a portion of tie rod 38. Outer housing 18 includes terminal box 46 and plenum 48. Within outer housing 18 are diffuser 50, motor bearing cooling tube 52, and wire transfer tube 54. A fan inlet is a source of air to be moved by ram air fan assembly 10 in the absence of sufficient ram air pressure. A bypass inlet is a source of air that moves through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 and inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 25 is contained within motor stator 26 and connects journal bearing shaft 34 to thrust shaft 28. Journal bearing shaft 34, motor rotor 25, and thrust shaft 28 define an axis of rotation for ram fan assembly 10. Fan rotor 42 is attached to thrust shaft 28 with tie rod 38 extending along the axis of rotation from shaft cap 36 at the end of journal bearing shaft 34 through motor rotor 25, thrust shaft 28, and fan rotor 42 to hub 45 and shroud 44. Nuts (not shown) secure shaft cap 36 to journal bearing shaft 34 on one end of tie rod 38 and hub 45 and shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Hub 45, shroud 44, fan rotor 42, and a portion of fan housing 12 are contained within inlet housing 16. Diffuser 50 is attached to an inner surface of outer housing 18. Plenum 48 is a portion of outer housing 18 that connects ram air fan assembly 10 to the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14. Energizing motor stator 26 causes rotor 24 to rotate about the axis of rotation of ram fan assembly 10, rotating connected journal bearing shaft 34 and thrust shaft 28. Fan rotor 42, hub 45, and shroud 44 also rotate by way of their connection to thrust shaft 28. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, it flows past diffuser 50 and inner housing 20, where the air pressure is reduced due to the shape of diffuser 50 and the shape of inner housing 20. Once past inner housing 20, the air moves out of outer housing 18 at the fan outlet.

Components within bearing housing 14 and fan housing 12, especially thrust bearings 32, journal bearings 40 and motor 24, generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling bearings 32, 40 and motor components. Cooling air then exits fan housing 12 through cooling holes in rotor 42.

Figure 2A:
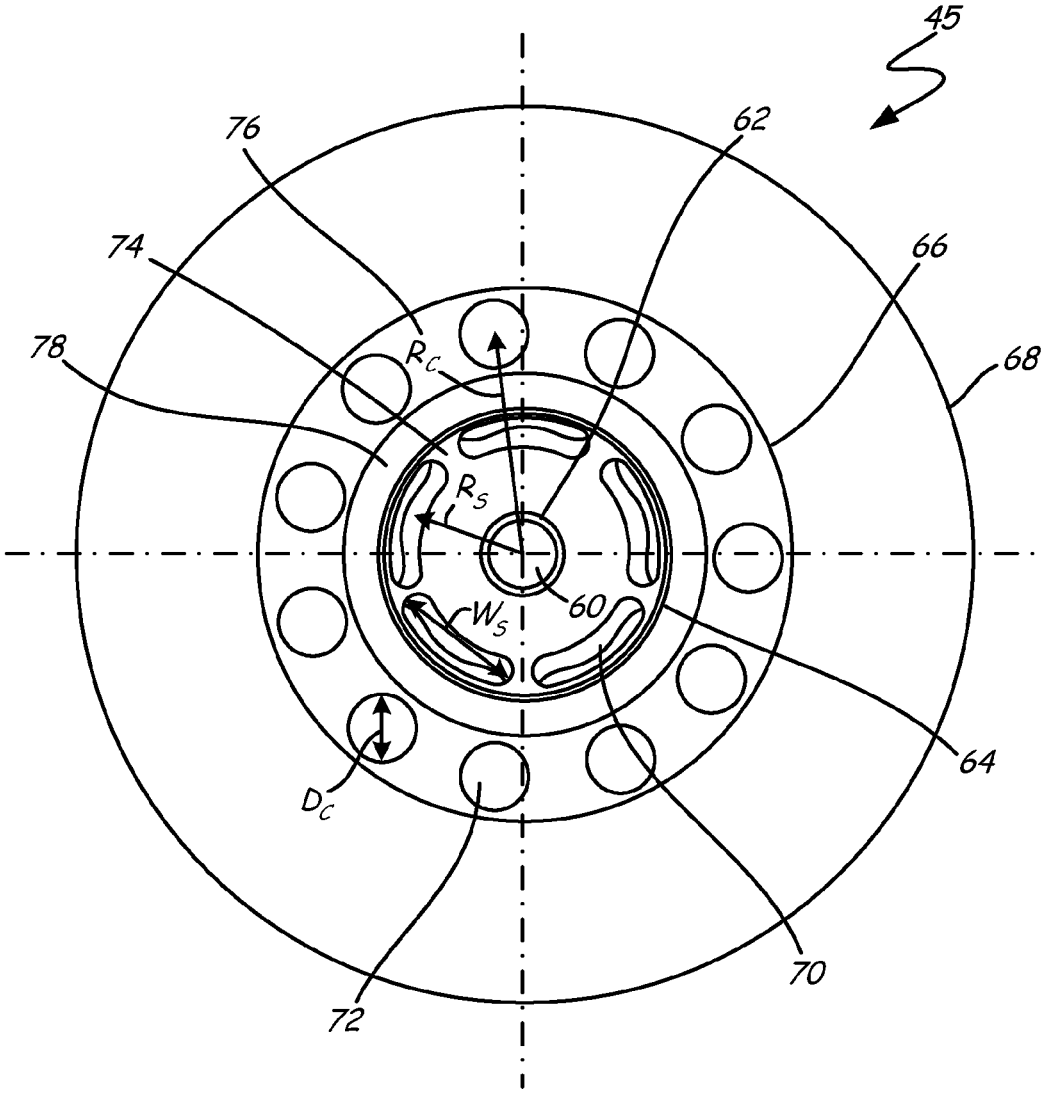
FIG. 2A is a front elevation view of a hub.
Figure 2B:
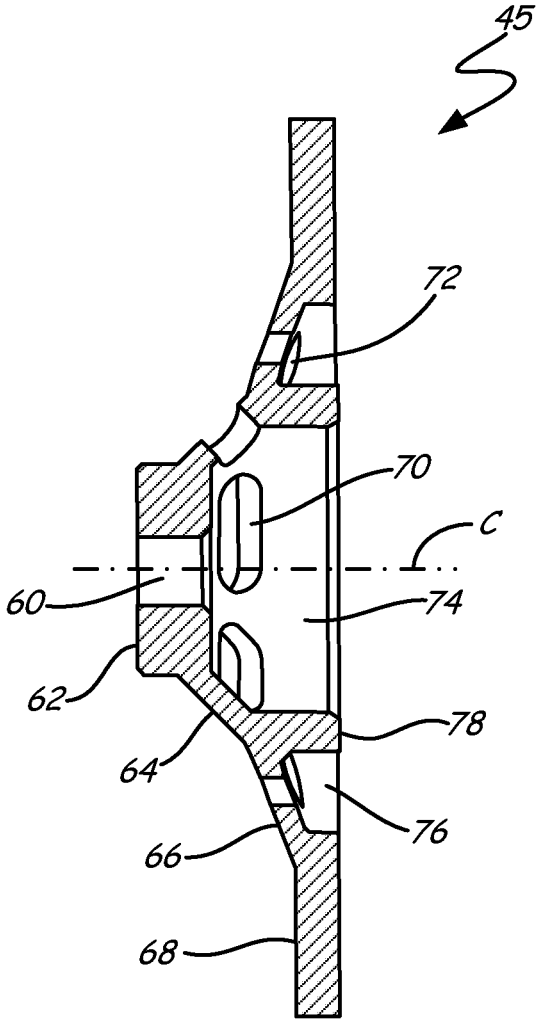
FIG. 2B is a cross-sectional view of the hub of FIG. 2A.

FIG. 2A is a front elevation view of hub 45. FIG. 2B is a cross-sectional view of hub 45. Referring to FIGS. 2A-2B, hub 45 includes center axis C, center bore 60, central hub 62, first frustoconical section 64, second frustoconical section 66, rim 68, slotted cooling holes 70, circular cooling holes 72, central cavity 74, annular cavity 76, and internal flange 78. Center bore 60 is centered on central axis C in the middle of central hub 62. Center bore 60 has an outer diameter of about 0.371 inches (9.42 millimeters (mm)) to 0.372 inches (9.45 mm) and receives a portion of tie rod 38. Central hub 62 has an outer diameter of about 1.1395 inches (28.94 mm) to 1.1405 inches (28.97 mm) and extends radially outward from center bore 60. The axially rearward face of central hub 62 is placed against shroud 44.

First frustoconical section 64 is radially outward and axially forward of central hub 62. First frustoconical section 64 is angled 43 degrees to 47 degrees from central hub 45 and has a radially outward and axially forward diameter of about 1.1395 inches (28.943 mm) to 1.1405 inches (28.969 mm). Slotted cooling holes 70 are located on first frustoconical section 64 and include five holes equally spaced around center bore 60. Slotted cooling holes 70 have circumferential width $W_s$ of about 0.633 inches (16.078 mm) to 0.713 inches (18.110 mm). The centers of slotted cooling holes 70 are located at radius $R_s$ about 0.660 inches (16.764 mm) to 0.700 inches (17.780 mm) from center axis C.

Second frustoconical section 66 is radially outward and axially forward of first frustoconical section 64. Rim 68 is radially outward and axially forward of second frustoconical section 68. Second frustoconical section 66 is angled 68 degrees to 72 degrees from central hub 45 and has a radially outward and axially forward diameter of about 3.27 inches (83.058 mm) to 3.32 inches (84.328 mm). Circular cooling holes 72 are located on second frustoconical section 66 and include eleven holes equally spaced around center bore 60. Circular cooling holes 72 have diameter $D_c$ of about 0.37 inches (9.398 mm) to 0.38 inches (9.652 mm). The centers of circular cooling holes 72 are located at radius $R_c$ about 1.19 inches (30.226 mm) to 1.21 inches (30.734 mm) from center axis C.

Rim 68 is radially outward and axially forward of second frustoconical section 66. Rim 68 has a flat face and an outer diameter of about 4.83 inches (122.682 mm) to 4.84 inches (122.936 mm). Central cavity 74 extends radially outward from center bore 60 and rearward of the forward face of hub 45. Central cavity 74 has an outer diameter of about 1.5242 inches (38.715 mm) to 1.5252 inches (38.740 mm) and is located in first frustoconical section 64. Internal flange 78 is radially outward of central cavity 74. Internal flange 78 has an inner diameter of about 1.5242 inches (38.715 mm) to 1.5252 inches (38.740 mm) and an outer diameter of about 1.955 inches (49.657 mm) to 1.965 inches (49.911 mm). Annular cavity 76 extends radially outward from internal flange 78 and rearward of the forward face of hub 45. Annular cavity 76 has an outer diameter of about 2.835 inches (72.009 mm) to 2.845 inches (72.263 mm) and is located in second frustoconical section 66.

Hub 45 is preferably made out of aluminum, but any suitable material could be used. Further, hub 45 is machined in the embodiment shown, but any suitable method of manufacture could be used. Central cavity 74 is shaped to receive a portion of fan rotor 42. Central hub 42 is shaped to fit into a cavity in shroud 44 to create an inlet shroud assembly. The inlet shroud assembly is further capable of being placed at one end of tie rod 38.

When ram air fan assembly 10 is in use, the components in bearing housing 14 and fan housing 12 generate a lot of heat. Motor bearing cooling tube 52 will intake a cooling air flow to cool these components. The air exits inner housing 20 through cooling holes in fan rotor 42, as seen in FIG. 1. This cooling air flow then travels through slotted cooling holes 70 and circular cooling holes 72 in hub 12. The air flowing through slotted cooling holes 70 is air used to cool the inside diameter of motor rotor 25. The air flowing through circular cooling holes 72 is air used to cool thrust bearings 32. The size of slotted cooling holes 70 and circular cooling holes 72 enhances the air flow through hub 12. The quantity and shape of slotted cooling holes 70 and circular cooling holes 72 help to enhance the structural strength of hub 45.

Figure 3:
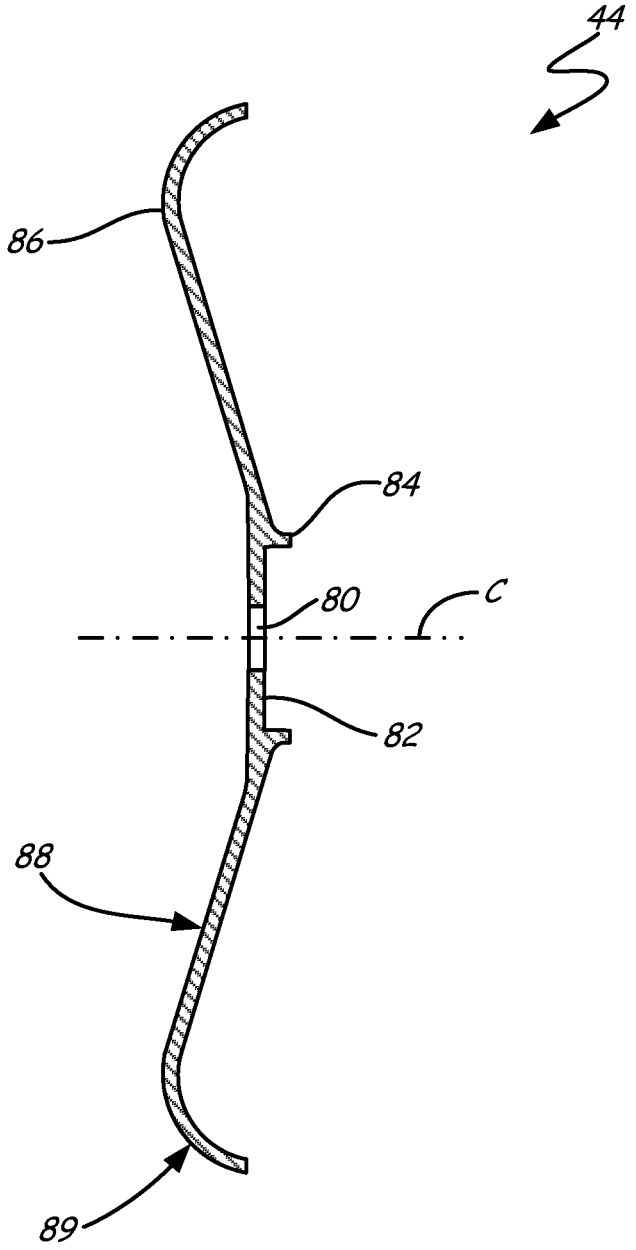
FIG. 3 is a cross-sectional view of a shroud.

FIG. 3 is a cross-sectional view of shroud 44. Shroud 44 includes center axis C, center bore 80, central disk 82, circular flange 84, and outer disk 86. Center bore 80 is centered on center axis C of shroud 44 and has a diameter of about 0.385 inches (9.779 mm) to 0.395 inches (10.033 mm). Central disk 82 extends radially outward from central bore 80 and has an outer diameter of about 1.1369 inches (28.877 mm) to 1.1379 inches (28.903 mm). Circular flange 84 is located on the axially forward face at the outer edge of central disk 82. Circular flange 84 extends axially forward about 0.14 inches (3.556 mm) to 0.16 inches (4.064 mm) from central disk 82. The radially inward surface of circular flange 84 and the axially forward face of central disk 82 create a cavity that is capable of receiving hub 45.

Outer disk 86 has a thickness of about 0.08 inches (2.032 mm) to 0.10 inches (2.540 mm) and an outer diameter of about 6.545 inches (166.243 mm) to 6.665 inches (169.291 mm). Outer disk 86 has web portion 88 with a substantially flat surface that extends radially outward and axially rearward of central disk 82. Web portion 88 extends at an angle of about 72 degrees to 76 degrees from central disk 82. Outer disk 86 also has a tip portion 89 that extends radially outward of central disk 82 with a curved lip that extends axially forward. Tip portion 89 curves axially forward at an angle of about 83.6 degrees to 87.6 degrees. Shroud 44 is made out of aluminum in the embodiment shown, but any suitable material could be used. Further, shroud 44 is machined in the embodiment shown, but any suitable method of manufacture could be used.

Shroud 44 is press fit to hub 45. As the cooling air flows through hub 45, the curvature of shroud 44 directs the air outside of inner housing 20. The shape of shroud 44 is designed to move the cooling air flow into inlet housing 16 and through the blades of fan rotor 42. Further, shroud 44 is shaped to prevent the cooling air from stalling or recirculating. The shape of shroud 44 allows ram air fan assembly 10 to ingest an optimal amount of cooling air flow, which lowers the amount of air that needs to be taken from the engine. This lessens the amount of power consumption that is needed to cool the airplane.

Figure 4A:
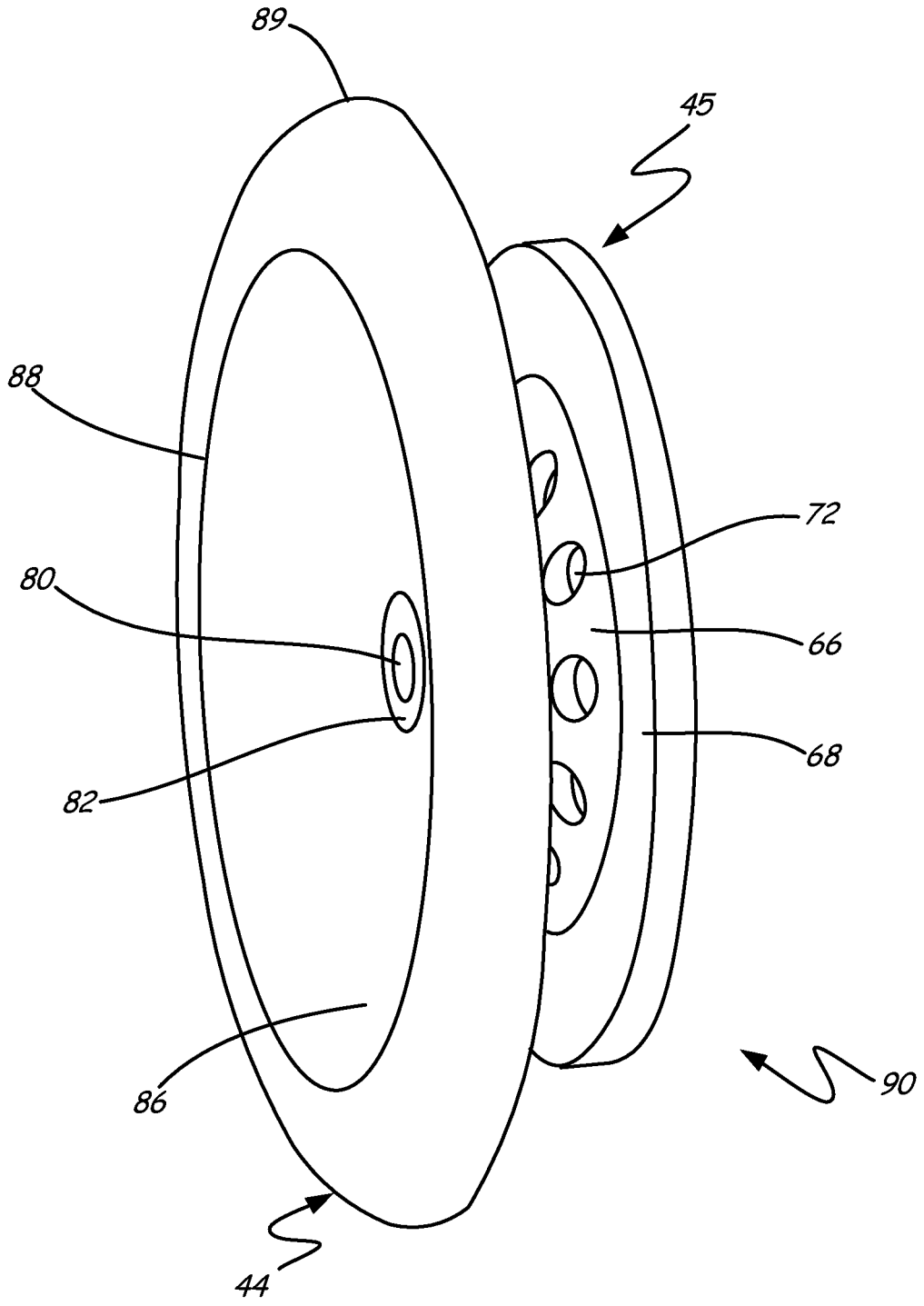
FIG. 4A is a perspective view of an inlet shroud assembly.
Figure 4B:
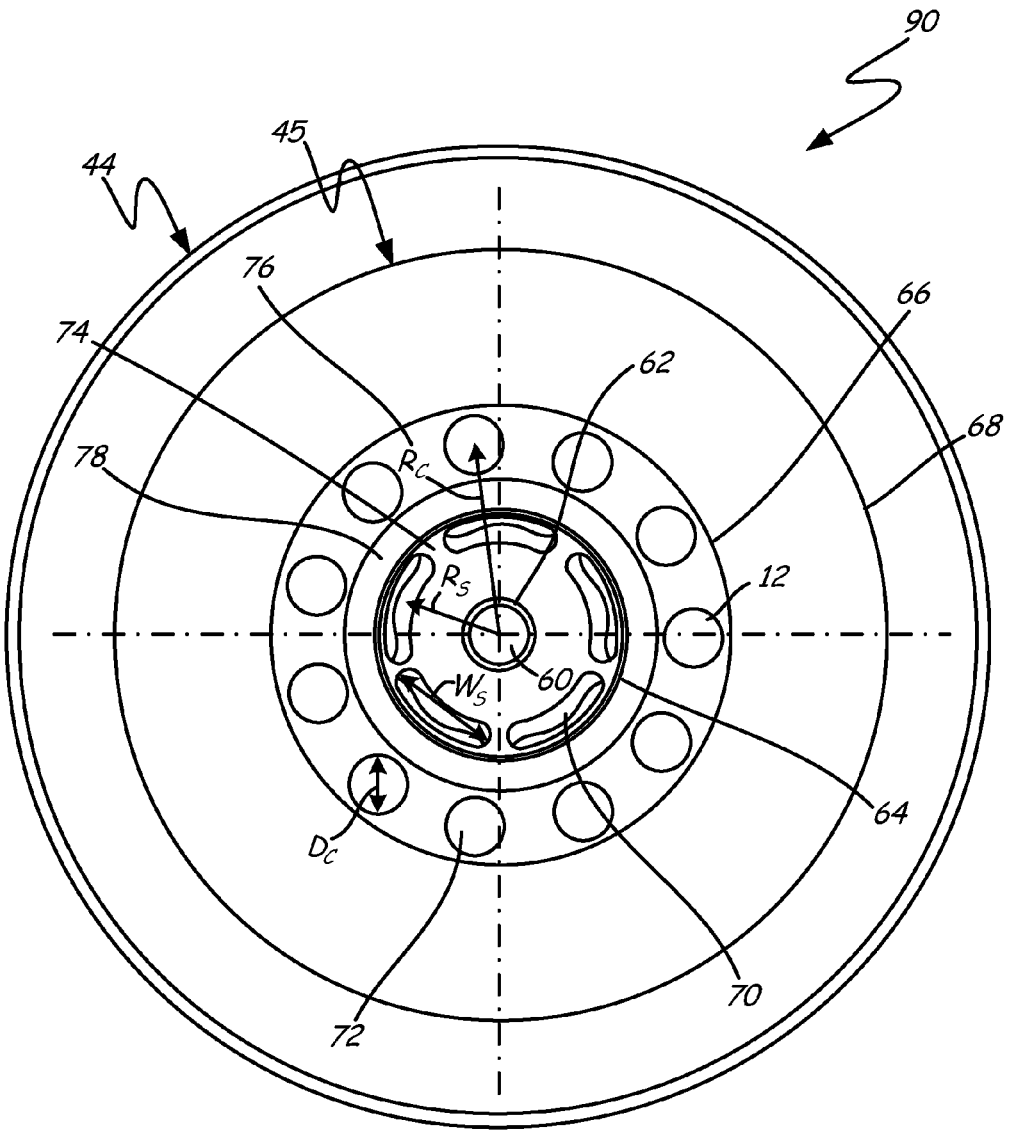
FIG. 4B is a front elevation view of the inlet shroud assembly of FIG. 4A.
Figure 4C:
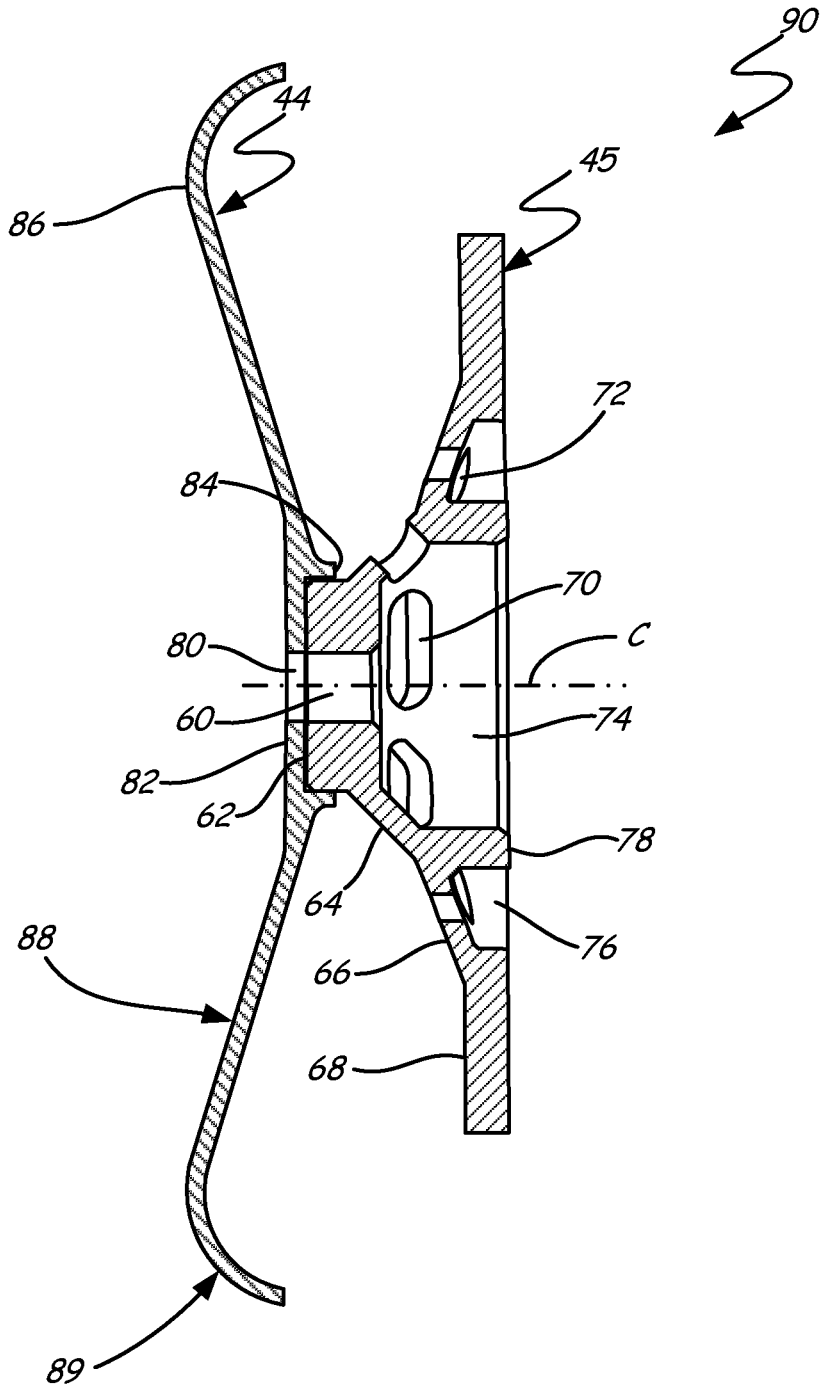
FIG. 4C is a cross-sectional view of the inlet shroud assembly of FIG. 4A.

FIG. 4A is a perspective view of inlet shroud assembly 90. FIG. 4B is a front elevation view of inlet shroud assembly 90. FIG. 4C is a cross-sectional view of inlet shroud assembly 90. Inlet shroud assembly 90 includes hub 45 and shroud 44. Hub 45 includes center bore 60, central hub 62, first frustoconical section 64, second frustoconical section 66, rim 68, slotted cooling holes 66, circular cooling holes 72, central cavity 74, annular cavity 76, and internal flange 78, as described above. Shroud 44 includes center bore 80, central disk 82, circular flange 84, and outer disk 86 with first portion 88 and second portion 89, as described above.

Hub 45 and shroud 44 are press fit together by lining them up along center axis C that runs through center bore 60 and center bore 80. The axially forward face of central disk 82 and the radially inward surface of circular flange 84 form a cavity in shroud 44. The rearward face and radially outward surface of central hub 62 form a flange on hub 45. The flange on hub 45 is designed to fit in the cavity on shroud 44. Hub 45 and shroud 44 are then fit together by press fitting to form inlet shroud assembly 90, although any suitable connection could be used, including other fits, adhesives, or fasteners. As stated above, the hub and shroud are machined parts made of aluminum in the embodiment shown, but any suitable material and method of manufacture can be used.

Inlet shroud assembly 90 is used in ram air fan assembly 10 to direct the cooling air flowing through inner housing 20 out into inlet housing 16. Once the cooling air is in inlet housing 16, the blades on fan rotor 42 will move the air into the space between inner housing 20 and outer housing 18 until it is expelled out of the forward end of outer housing 18. Inlet shroud assembly 90 is placed on tie rod 38 to keep fan rotor 42 in place in ram air fan assembly 10. Slotted cooling holes 70 and circular cooling holes 72 meter how much cooling air flows through journal bearings 40, thrust bearings 32, and motor rotor 25. The cooling air flows over these components to reduce the heat that is being generated when these parts are operated. The shape, size, and location of slotted cooling holes 70 and circular cooling holes 72 on inlet shroud assembly 90 enhances the cooling air flow split between thrust bearings 32 and motor rotor 25. Enhancing the air flow split minimizes the amount of cooling air flow needed, which reduces the amount of power consumption that is required to cool the airplane.

Figure 5:
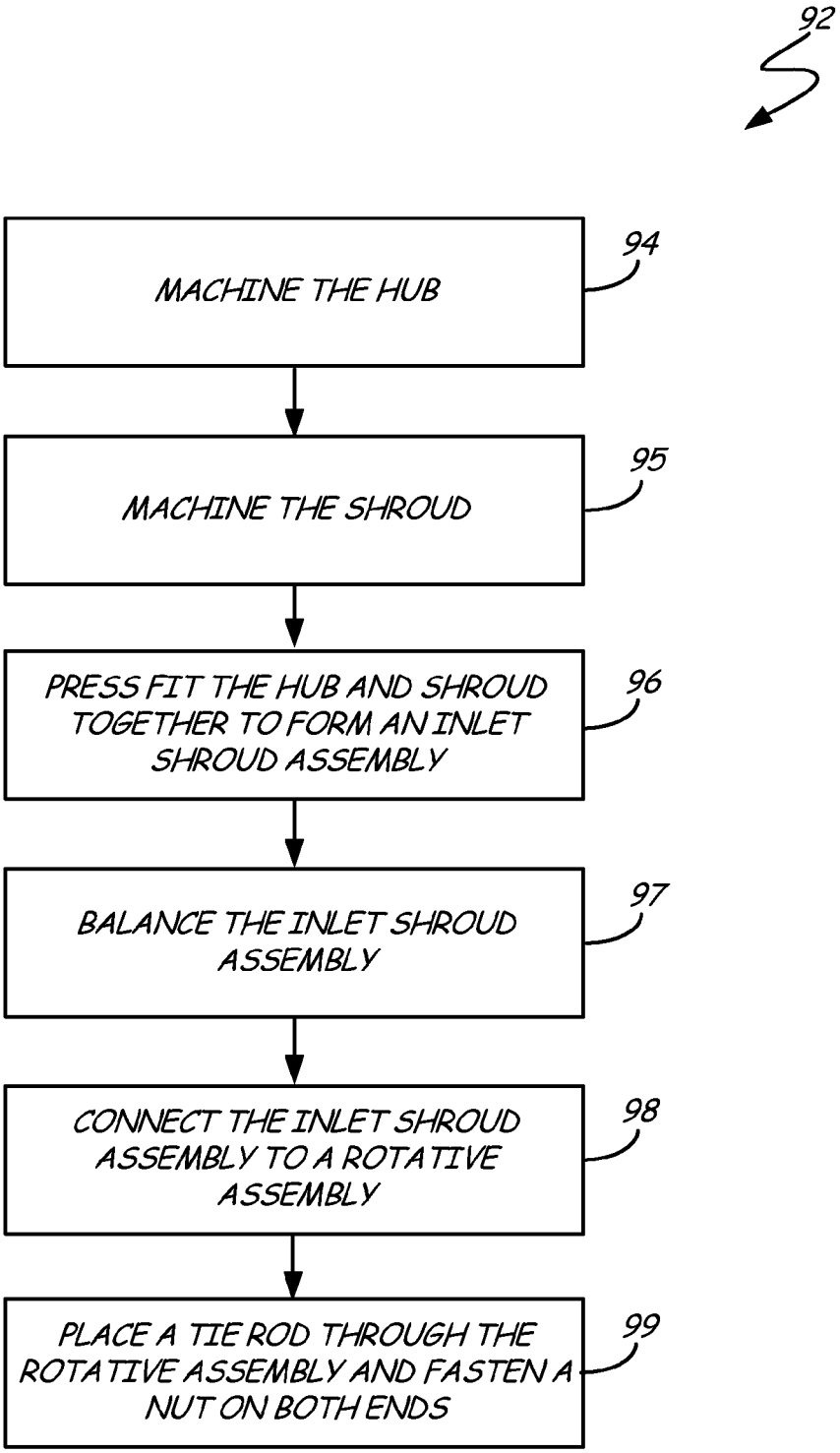
FIG. 5 is a block diagram showing a method for installing a hub and shroud assembly in a ram air fan assembly.

FIG. 5. is a block diagram showing a method 92 for installing inlet shroud assembly 90 in ram air fan assembly 10. The method includes: machining hub 45 (step 94); machining shroud 44 (step 95); connecting hub 45 and shroud 44 by press fitting them together to form inlet shroud assembly 90 (step 96); balancing inlet shroud assembly 90 (step 97); connecting inlet shroud assembly 90 with motor rotor 25, thrust shaft 28, fan rotor 42, bearing shaft 34, and shaft cap 36 (step 98); and placing tie rod 38 through cap shaft 36 and inlet shroud assembly 90 and fastening a nut on each end of tie rod 90 (step 99).

Step 94 includes machining hub 45, and step 95 includes machining shroud 44. Hub 45 and shroud 44 are each machined as individual pieces in the embodiment shown, but they can be machined together. Hub 45 and shroud 44 are preferably made of aluminum, although any suitable material can be used. Additionally, hub 45 and shroud 44 can be manufactured by any suitable means.

Step 96 includes fitting hub 45 and shroud 44 together, preferably by press fitting. This can be done in a variety of ways. One way is to shrink hub 45 by immersing it in liquid nitrogen, causing it to freeze and contact. Hub 45 can then be placed in a cavity on shroud 44 designed to receive hub 45. Hub 45 and shroud 44 form inlet shroud assembly 90. Inlet shroud assembly 90 can then be placed in a warmer environment. As hub 45 warms back up to room temperature it will expand and form a secure connection with shroud 44. A second way to fit hub 45 and shroud 44 together would be by using a hydraulic press to push hub 45 into shroud 44. Further, hub 45 and shroud 44 can be connected in many other ways, including other fits or using adhesives or fasteners. If hub 45 and shroud 44 are machined together in the first step, then this step is unnecessary.

Step 97 includes balancing inlet shroud assembly 90. This can be done using a balancing machine. Inlet shroud assembly 90 will be rotated on a shaft to determine the speed and rotating phase of inlet shroud assembly 90. A known weight will then be added to inlet shroud assembly 90 at a known angle so it can be measured how the weight affects the balance of inlet shroud assembly 90. This measure can be compared to the original measure to determine the weight and angles needed to bring the part into balance.

Step 98 includes connecting motor rotor 25, thrust shaft 28, fan rotor 42, bearing shaft 34, and shaft cap 36, to inlet shroud assembly 90. These parts can be connected with various connections, including interference fits, fasteners, or other methods. Connections must be secure so that all part rotate together.

Step 99 includes placing tie rod 38 through shaft cap 36 and inlet shroud assembly 90. Tie rod 38 is then stretched using a machine that pulls on each end of tie rod 38. Nuts can then be fastened onto each end of tie rod 38 and the stretch on tie rod 38 can be released. This secures a pre-load on tie rod 38. The pre-load on tie rod 38 clamps together the parts to ensure secure connections and promote uniform rotation. The process of stretching tie rod 38, tightening the nuts, and releasing the stretch can be performed an additional time to add more pre-load to tie rod 38.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A hub for a ram air fan, the hub comprising:

a central hub with a center bore;

a first frustoconical section radially outward and axially forward of the central hub;

a plurality of slotted cooling holes on the first frustoconical section;

a second frustoconical section radially outward and axially forward of the first frustoconical section;

a plurality of circular cooling holes on the second frustoconical section;

a rim radially outward and axially forward of the second frustoconical section;

a central cavity axially forward of the central hub; and an annular cavity radially outward and axially forward of the central hub.

2. The hub of claim 1, wherein the plurality of slotted cooling holes comprise five cooling holes equally spaced around a central axis of the hub at a radius of 0.660 inches (16.764 mm) to 0.700 inches (17.78 mm).

3. The hub of claim 1, wherein the plurality of circular cooling holes comprises eleven cooling holes equally spaced around a central axis of the hub at a radius of 1.19 inches (30.226 mm) to 1.21 inches (30.734 mm).

4. The hub of claim 1, wherein the slotted cooling holes each have a circumferential width between 0.633 inches (16.078 mm) and 0.713 inches (18.110 mm).

5. The hub of claim 1, wherein the circular cooling holes each have a diameter between 0.37 inches (9.398 mm) and 0.38 inches (9.652 mm).

6. The hub of claim 1, wherein the first frustoconical section is angled 43 degrees to 47 degrees from the central hub and the second frustoconical section is angled 68 degrees to 72 degrees from the central hub.

7. The hub of claim 1, wherein the central cavity has a circular shape with an outer diameter of 1.5242 inches (38.715 mm) and 1.5252 inches (38.740 mm).

8. The hub of claim 1, wherein the annular cavity has an inner diameter of 1.955 inches (49.657 mm) to 1.965 inches (49.911 mm) and an outer diameter of 2.835 inches (72.009mm) to 2.845 inches (72.263 mm).

9. A shroud for a ram air fan, the shroud comprising: a central disk with a center bore; a circular flange located on a radially outer edge of the central disk, wherein the circular flange is located at a diameter of 1.1369 inches (28.877 mm) to 1.1379 inches (28.903 mm) from a center of the central disk; and an outer disk with a web portion extending radially outward and axially rearward of the central disk and a tip portion extending radially outward of the web portion with a curved lip extending axially forward towards the central disk.

10. The shroud of claim 9, wherein the web portion of the outer disk is angled 72 degrees to 76 degrees from the central disk and the tip portion of the outer disk curves at an angle of 83.6 degrees to 87.6 degrees from the central disk.

11. An inlet shroud assembly comprising a hub and a shroud for a ram air fan, the inlet shroud assembly comprising:

a hub, wherein the hub comprises:

a central hub with a center bore;

a first frustoconical section radially outward and axially forward of the central hub;

a plurality of slotted cooling holes on the first frustoconical section;

a second frustoconical section radially outward and axially forward of the first frustoconical section;

a plurality of circular cooling holes on the second frustoconical section;

a rim radially outward and axially forward of the second frustoconical section;

a central cavity axially forward of the central hub; and an annular cavity radially outward and axially forward of the central hub; and a shroud, wherein the shroud comprises:

a central disk with a center bore;

a circular flange located on a radially outer edge of the central disk; and an outer disk with a web portion extending radially outward and axially rearward of the central disk and a tip portion extending radially outward of the web portion with a curved lip extending axially forward towards the central disk.

12. The inlet shroud assembly of claim 11, wherein the plurality of slotted cooling holes comprise five cooling holes equally spaced around a central axis of the hub at a radius of 0.660 inches (16.764 mm) to 0.700 inches (17.78 mm).

13. The inlet shroud assembly of claim 11, wherein the plurality of circular cooling holes comprises eleven cooling holes equally spaced around a central axis of the hub at a radius of 1.19 inches (30.226 mm) to 1.21 inches (30.734 mm).

14. The inlet shroud assembly of claim 11, wherein the slotted cooling holes each have a circumferential width between 0.633 inches (16.078 mm) and 0.713 inches (18.110 mm).

15. The inlet shroud assembly of claim 11, wherein the circular cooling holes each have a diameter between 0.370 inches (9.398 mm) and 0.38 inches (9.652 mm).

16. The inlet shroud assembly of claim 11, wherein the first frustoconical section is angled 43 degrees to 47 degrees from the central hub and the second frustoconical section is angled 68 degrees to 72 degrees from the central hub.

17. The inlet shroud assembly of claim 11, wherein the web portion of the outer disk is angled 72 degrees to 76 degrees from the central disk and the tip portion of the outer disk curves at an angle of 83.6 degrees to 87.6 degrees from the central disk.

18. The inlet shroud assembly of claim 11, wherein the circular flange is located at a diameter of 1.1369 inches (28.877 mm) to 1.1379 inches (28.903 mm) from a center axis.

19. The inlet shroud assembly of claim 11, wherein the hub and shroud are press fit together and attached with a tie rod.

* * * * *